United States Patent [19]

Raudat

[11] 4,448,009

[45] May 15, 1984

[54] FINGER ASSEMBLY FOR A CASE LOADER

[75] Inventor: John L. Raudat, North Madison, Conn.

[73] Assignee: Standard-Knapp, Inc., Portland, Conn.

[21] Appl. No.: 273,012

[22] Filed: Jun. 12, 1981

Related U.S. Application Data

[63] Continuation-in-part of Ser. No. 182,103, Aug. 20, 1980, abandoned, which is a continuation-in-part of Ser. No. 135,508, Mar. 31, 1980, abandoned.

[51] Int. Cl.[3] ..... B65B 21/16

[52] U.S. Cl. ..... 53/248

[58] Field of Search ..... 53/247, 248, 262, 532

[56] References Cited

U.S. PATENT DOCUMENTS

| | | | |
|---|---|---|---|
| 3,911,647 | 10/1975 | Hartness | 53/248 |
| 4,075,819 | 2/1978 | Raudat | 53/248 |
| 4,171,603 | 10/1979 | Wiseman | 53/248 |
| 4,207,721 | 6/1980 | Raudat | 53/248 |
| 4,248,028 | 2/1981 | Dardaine | 53/248 |
| 4,281,501 | 8/1981 | Rydell | 53/248 |

*Primary Examiner*—A. J. Heinz

*Attorney, Agent, or Firm*—McCormick, Paulding & Huber

[57] ABSTRACT

A finger assembly includes a holder supported in depending position on a horizontal rail in the case loader. Fingers extend downwardly and outwardly from the holder and are resiliently clamped therein by a retaining member. An elongated fastener extends upwardly through the retaining member and has its upper end secured in the holder. The retaining member is spring biased upwardly against inturned fulcrum defining portions of each finger and said retaining member cooperates with a downwardly open cavity in the holder to define a plurality of finger sockets therebetween. The fingers are held for limited movement toward and away from centered positions associated with pockets defined in the case loader for the articles being loaded, and each finger is also adapted for limited lateral movement in its associated socket, at least when the finger is not in its centered position in a pocket. Two retaining member versions are disclosed, one with an axially symmetrical retaining member, and another with a four sided retainer to avoid the need for a depending skirt on the holder. These retaining members can be used with four fingers per pocket or article passageway, and with two fingers per pocket to reduce the number of holders and retainers (as well as the number of fingers) in a case loader capable of handling a given number of articles in a charge or slug.

15 Claims, 32 Drawing Figures

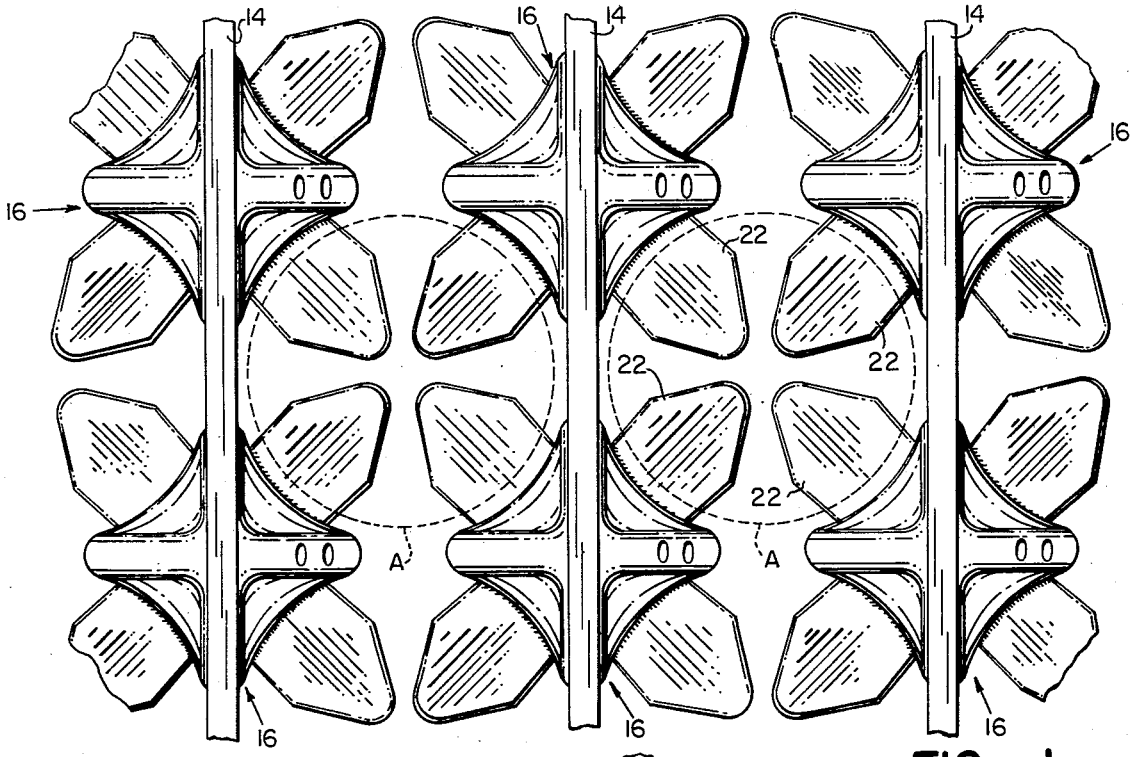
FIG. 1
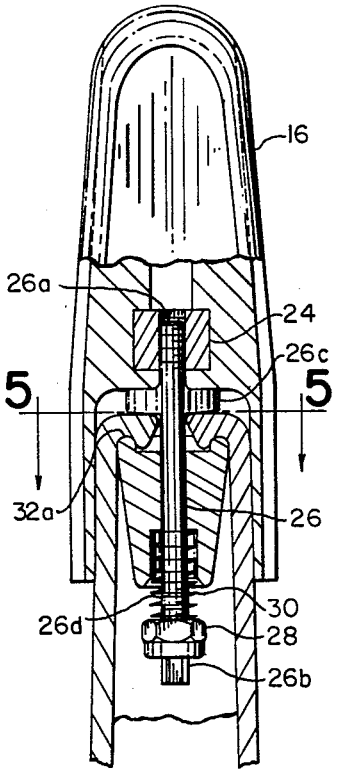
FIG. 3
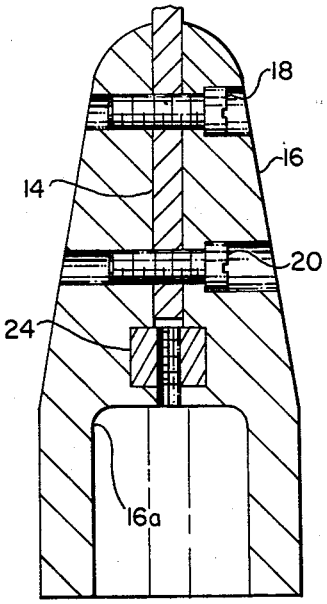
FIG. 4
FIG. 2
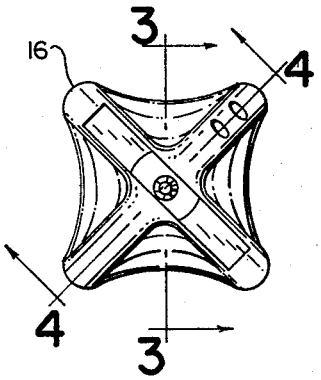
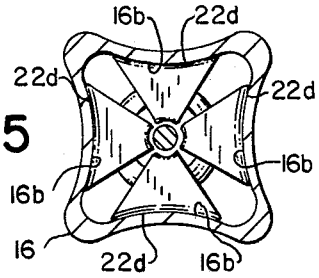
FIG. 5

FIG. 16
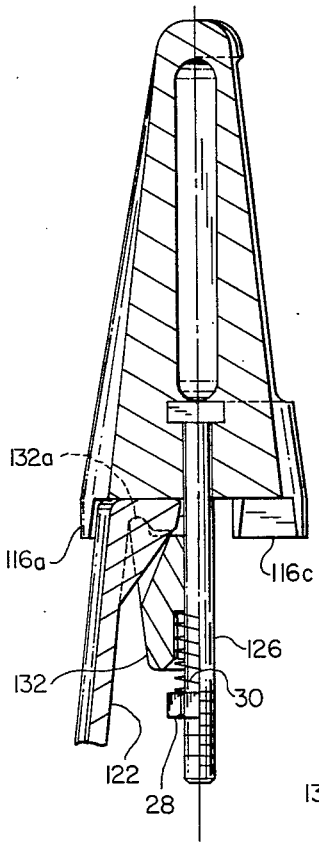
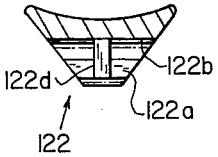
FIG. 21
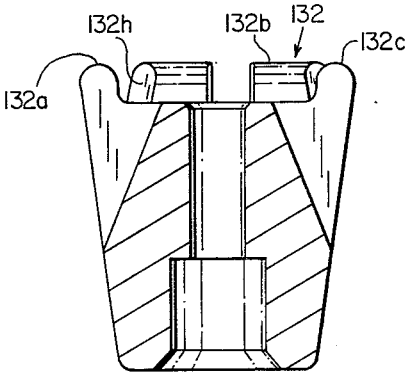
FIG. 18
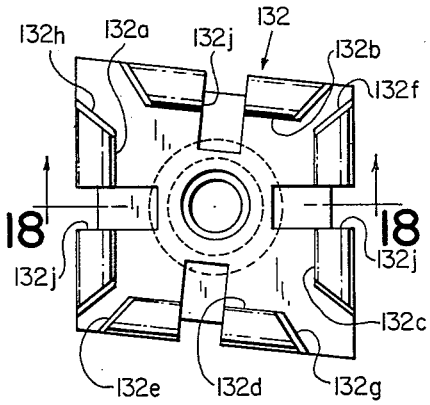
FIG. 17
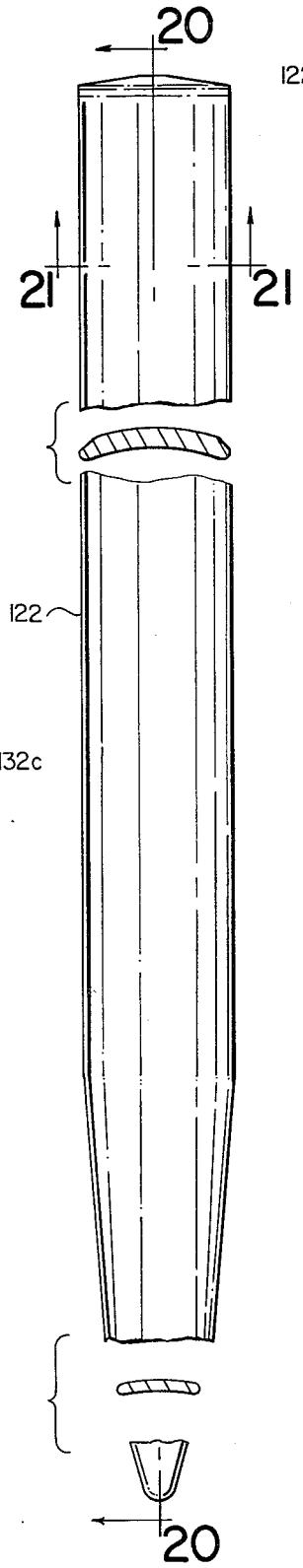
FIG. 19
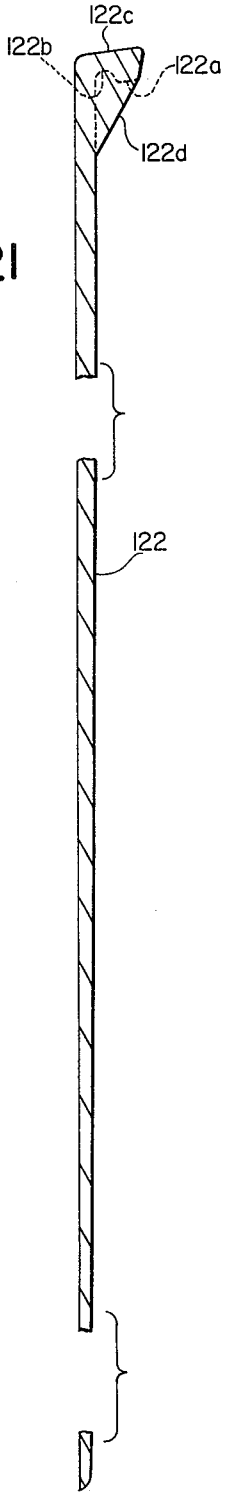
FIG. 20

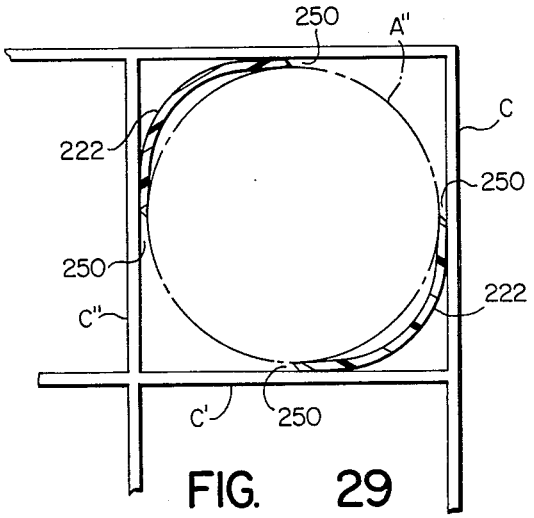
FIG. 29
FIG. 30
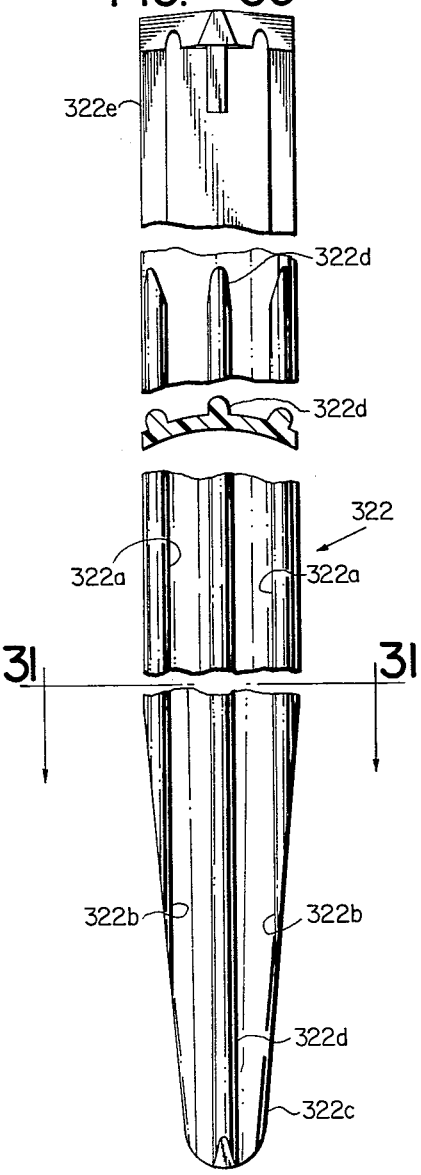
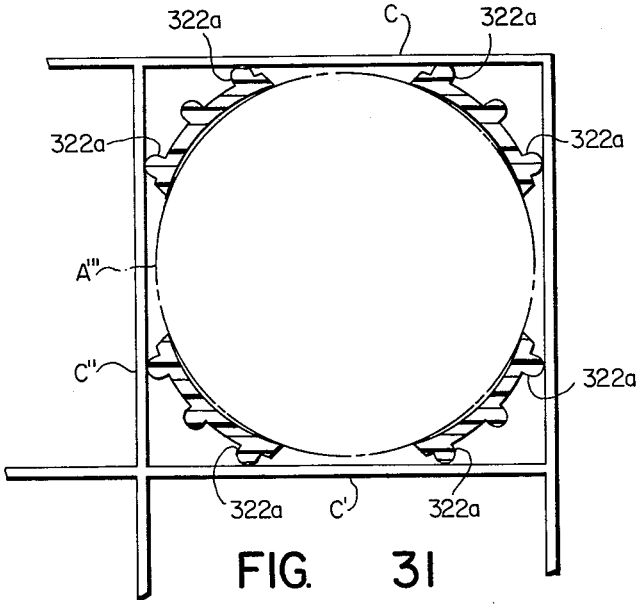
FIG. 31

FINGER ASSEMBLY FOR A CASE LOADER

CROSS REFERENCE TO RELATED APPLICATIONS

This application is a continuation-in-part application of an earlier continuation-in-part filed Aug. 20, 1980 (Ser. No. 182,103). The latter was also a continuation-in-part of an original filed Mar. 31, 1980 by the same applicant and title under United States Patent and Trademark Office Ser. No. 135,508. Both said applications have been abandoned in favor of the subject application.

BACKGROUND OF THE INVENTION

This invention relates generally to case loading machines of the type which include a grid assembly for handling groups or slugs of articles to be loaded into an upwardly open packing case. The invention relates more particulary to an improved finger assembly for the grid assembly of such a case loader.

A machine of the above described type is generally used to pack articles of uniform size and shape, as for example bottles, can, or similar articles, in cases or cartons which may be provided with compartments or cells for holding the individual articles. A charge or slug of articles to be loaded is accumulated in a grid assembly, and the said assembly includes means for discharging the entire slug of articles, for gravity fall, downwardly into an upwardly open carton or case. Finger assemblies or clusters are generally mounted to parallel rails in the grid assembly, either at the sides of individual passages for the article, or at the corners of these generally square passages. Such assemblies are usually supported below the shifting grid frame, which serves to control the release for gravity fall of the charge as it drops from the frame into the case. In my co-pending application Ser. No. 963,361, filed Nov. 24, 1978, now U.S. Pat. No. 4,207,722, a finger assembly is disclosed such that a single screw or fastener is provided to hold four fingers at the corner of each of four adjacent pockets or passages in the grid assembly. Since the fingers themselves may become damaged or broken by being repeatedly struck by falling articles, and by the cases moving upwardly into loading position on an elevator or the like, my prior patent shows a convenient means for permitting these fingers to be readily removed for replacement or repair.

The present invention seeks to carry forward the advantages of the previous disclosure, and to provide an improved finger assembly such that each of the four fingers in a corner cluster are biased toward a normal position and such that each finger can not only move from this normal position toward the corner of the case pocket associated therewith, but which finger is also adapted for limited lateral movement to accommodate misalignment between the grid assembly and the case partitions lending to interference between the depending finger and a cell or partition within the packing case to be loaded.

SUMMARY OF THE INVENTION

In accordance with the present invention an improved finger assembly for a case loader is provided which includes a finger holder of the type adapted to support up to four fingers in four adjacent corners of four associated pockets in a typical grid assembly. Means is provided for mounting the finger holder in depending position on the rail of the grid assembly and one, two, three or four flexible fingers are adapted to extend downwardly and outwardly from a downwardly open cavity in this finger holder. Each finger is releasably retained in the assembly by opposed clamping or retaining surfaces in the holder and in a finger retaining member, and each finger is capable of limited pivoted movement, not only toward and away from a normal centered position associated with a particular pocket, but is also capable of limited lateral movement in a direction perpendicular to such pivotal motion. A single fastener extends upwardly through the retaining member and carries a coiled compression spring such that the restoring force on all of the fingers in a particular finger assembly can be varied to cause its associated fingers to be urged toward their normal positions wherein each projects outwardly toward the center of an associated pocket. The use of a single clamping fastener and single biasing spring for a particular cluster of fingers permits the removal for replacement or repair of all of these movable fingers in a particular holder in a manner not heretofore possible.

BRIEF DESCRIPTION OF THE DRAWINGS

FIG. 1 is a fragmentary plan view of a portion of a case loader having finger assemblies embodying the present invention provided therein.

FIG. 2 is a plan view of one of the finger holders depicted in the previous view.

FIG. 3 is a vertical sectional view taken generally on the line 3—3 of FIG. 2, and also showing in pertinent part three of the four fingers in a particular cluster of four such fingers.

FIG. 4 is a sectional view taken generally on the line 4—4 of FIG. 2.

FIG. 5 is a horizontal sectional view taken generally on the line 5—5 of FIG. 3.

FIG. 16 is a vertical sectional view taken generally on the line 16—16 of FIG. 12, but with one finger shown held in place by a retaining member and spring substantially as shown in FIG. 3 of the previous embodiment.

FIG. 17 is a plan view of the retaining member depicted in FIG. 16.

FIG. 18 is a vertical sectional view of the FIG. 17 retaining member, being taken generally on the line 18—18 of that view.

FIG. 19 is an elevational view of one finger such as shown in FIGS. 11 and 16 with cross sectional subviews included at two points along the fingers length.

FIG. 20 is a vertical sectional view taken generally on the line 20—20 of FIG. 19.

FIG. 21 is a sectional view taken generally on the line 21—21 of FIG. 19.

FIG. 29 is a horizontal sectional view, similar to FIG. 25A, but also showing the two fingers of FIGS. 24–28 inserted in a multi-cell partitioned case.

FIG. 30 is an elevational view of a finger similar to that shown in FIG. 20, but having a different cross sectional geometry.

FIG. 31 is a horizontal sectional view taken along the line 31—31 of FIG. 30, but also showing four such fingers in cooperation with a multi-cell partitioned case of the type shown in FIG. 29.

DETAILED DESCRIPTION OF FIGS. 1–10

Figure 6:
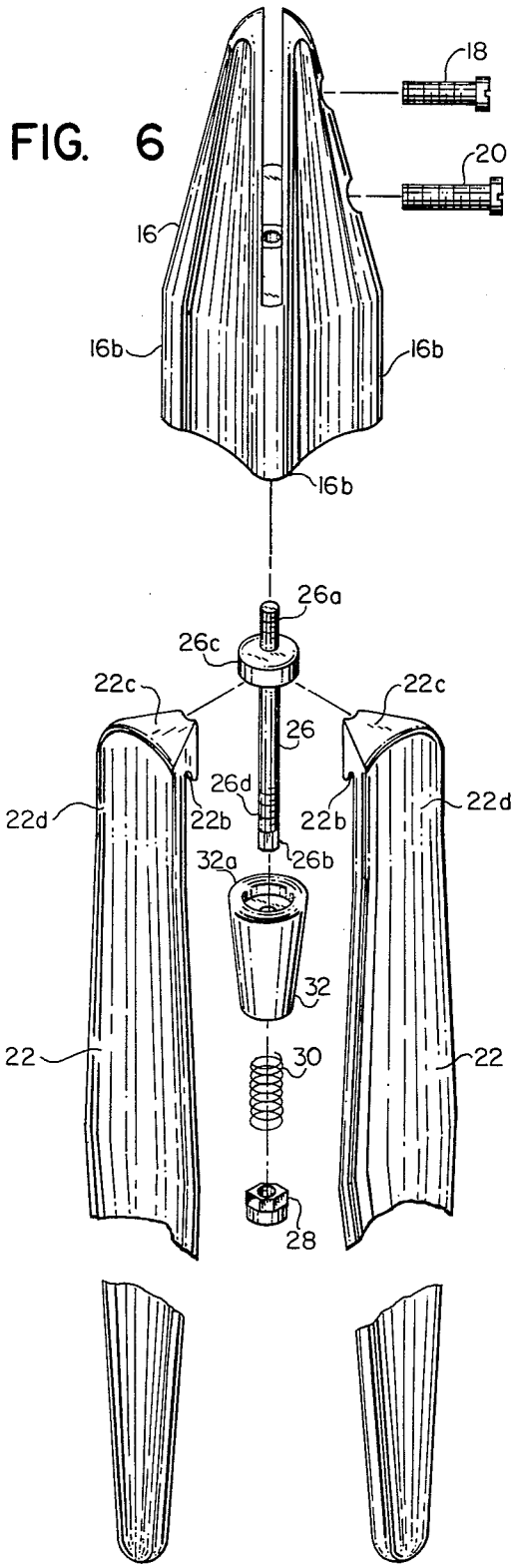
FIG. 6 is an exploded view of the holder depicted in FIGS. 2, 3, and 4, but illustrating only two of the four fingers at a typical corner finger assembly.
Figure 7:
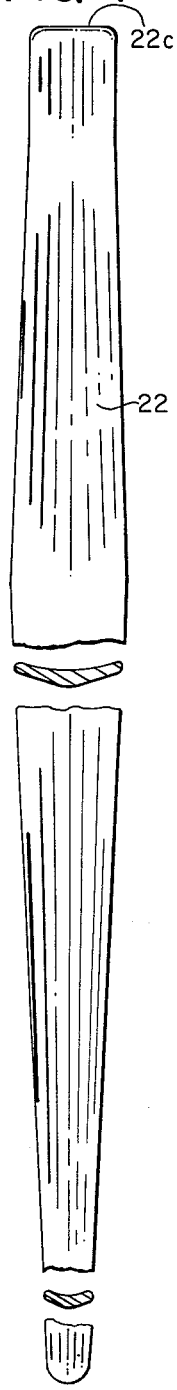
FIG. 7 is an elevational view of one of the fingers shown in FIG. 6 with portions broken away to reveal the configuration of the lateral section of this finger at two locations.
Figure 8:
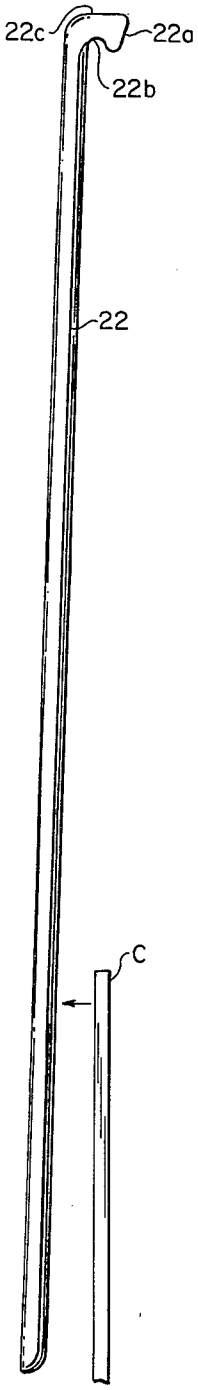
FIG. 8 is a side elevational view of the finger shown in FIG. 7 to which has been added for references purposes a portion of a case or a cell partition within the case being loaded.

Turning now to FIGS. 1–10 of the drawings in greater detail, and referring particularly to FIG. 1, a portion of a case loading machine is there shown as having a grid assembly, including parallel mounting rails 14, 14 which may be supported below a shifting grid frame (not shown) such that a slug of articles can be formed in aligned rows prior to being dropped downwardly through the pockets defined by finger assemblies 16, 16 secured to the rails 14, 14 at spaced locations. The finger assemblies define a plurality of such pockets, each of which is suitable for receiving an article to be loaded by gravity in the case provided therebelow. Two such pockets are illustrated in full in FIG. 1, and articles A, A are illustrated in broken lines as they would appear in the process of being dropped downwardly into the grid assembly itself.

The rails 14, 14 are usually supported in the grid assembly so as to be adjustable toward and away from one another, and the holders 16, 16 are also supported for adjustable movement on these rails to accommodate articles of various size. Each rail thus carries a longitudinally spaced series of finger holders 16, 16 and these finger holders are supported by screws 18 and 20 best shown in FIG. 4.

As so constructed and arranged each finger holder 16 supports one or more fingers at the corners of the pockets defined by these holders and the rails upon which they are supported. Means to be described supports each of these fingers so that it normally occupies a position as indicated in FIG. 1 with the result that the downwardly moving article A engages the four fingers associated with each of the pockets with the result that each finger is pivoted outwardly of the pocket and toward the corner thereof against the biasing force of a spring to be described in order that the articles can be decelerated slightly and guided into the cells of the packing case positioned therebelow. Thus, the fingers 22, 22 of adjacent assemblies 16, 16 cooperate to define article directing channels for controlling the gravity fall of articles A, A as the articles drop into packing cases provided for this purpose on a platform or elevator (not shown). A typical grid assembly is shown in my prior U.S. Pat. No. 3,561,189 assigned to the assignee herein and said prior patent is adopted by reference in its entirety for purposes of this disclosure. Reference may be had to the aforesaid patent and to the aforesaid patent application filed by me for expanding upon this disclosure of a preferred grid assembly.

Referring more particularly to FIG. 4, the finger holder 16 is adapted to be mounted in depending relationship to the rail 14 by the screws 18 and 20 as shown, and the holder 16 defines a downwardly open cavity 16*a* for receiving the cluster of one or more fingers 22, 22. A threaded nut 24 is embedded in the holder 16 so as to receive the upper end portion of a fastener 26 as shown in FIG. 3.

The holder 16 defines fluted portions 16*b*, 16*b* two of which fluted portions are aligned with the rail 14 upon which the holder is mounted. The holder 16 is shown in perspective in FIG. 6 and the fastener 26 with its threaded upper end portion 26a is also shown in this view. As shown in FIG. 3, this threaded portion 26a of the fastener 26 is adapted to be threadably received in the nut 24 referred to previously. This fastener is secured in place by tightening the fastener through the medium of its exposed lower end portion 26b until the flanged collar 26c of the fastener 26 engages the inner surface of the cavity 16a and the holder 16.

The above mentioned fastener 26 has a threaded lower portion 26d which carries a nut 28 and it is an important feature of the present invention that the nut 28 engages one end of a coiled compression spring 30 such that the upper end of spring 30 engages the inside of a retaining member 32 of annular configuration in order to provide a predetermined biasing force on the retaining member 32. This force on retainer causes the fingers 22, 22 and more particularly the upper end portions of the fingers to be retained or clamped between the flange 26c on fastener 26 and an annular rib 32a provided for this purpose on the annular retainer 32.

Each finger 22 has an upper end portion defining a hook or inturned end 22a which is adapted to be received inside an upwardly open cavity 32b defined for this purpose in the upper end of retainer 32. As so constructed and arranged the concave inner portion of the hooked end 22a of the finger 22 is adapted to engage the annular rib 32a of the retainer and to provide a pivotal connection for the finger 22 such that the finger can move toward and away from the axis of the fastener 26 as suggested by the solid and phantom line positions for the finger 22 in FIG. 9. It will be further apparent from FIG. 9 that this pivotal motion of the finger 22 is accompanied by vertical motion of the retainer 32 against the force of the spring 30 such that the spring 30 provides a restoring force for the fingers and tends to urge the fingers outwardly with respect to the fastener 26 and thereby tends to center the fingers in the positions shown for the plurality of fingers indicated for each of the pockets in the grid assembly of FIG. 1. The concave portion 22b at the upper end of finger 22 in FIG. 8 complements the upwardly facing rib 32a of the retainer for this purpose.

Figure 9:
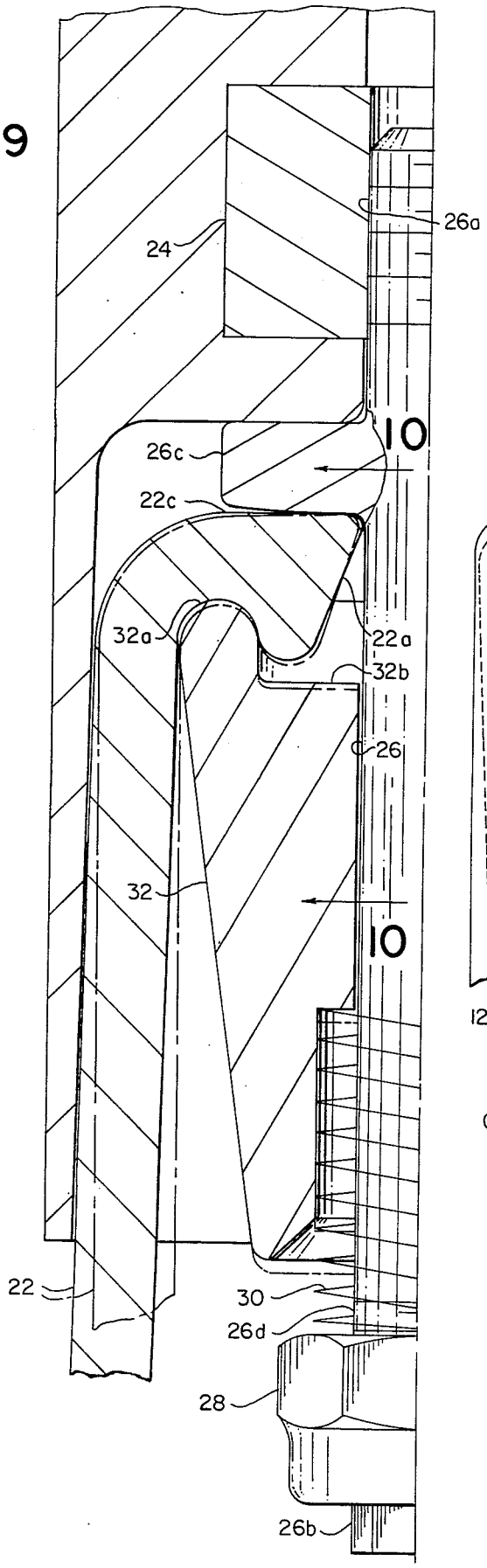
FIG. 9 is a sectional view drawn to an enlarged scale being generally similar to that of FIG. 3, but showing the finger in two alternative positions, the solid line position being its normal position and the phantom line position being a position wherein the finger is pivoted by engagement with a downwardly moving article as the article passes through the pocket with which this finger is associated.
Figure 10:
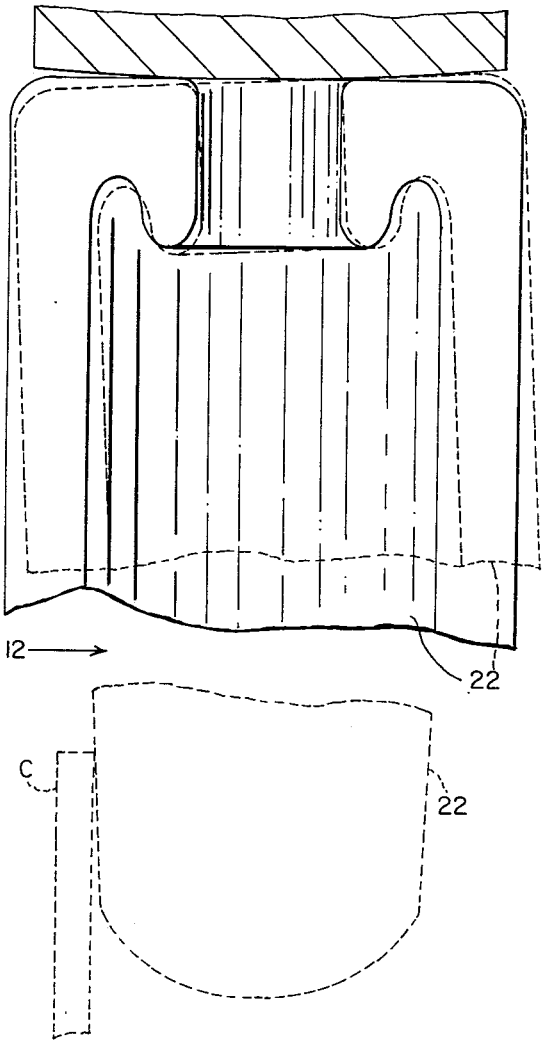
FIG. 10 is a sectional view taken generally on the line 10—10 of FIG. 9, but with the finger retaining member being omitted, and with the finger itself being shown in a solid line position corresponding to that of FIG. 9 and a broken line position wherein the finger is deflected laterally as suggested by the arrow in FIG. 10. In the lower portion of FIG. 10 the finger is illustrated in contact with a cell forming partition within the case to illustrate the finger being moved in the direction of the arrow 12 by reason of the cell partition within the case being imprecisely aligned vertically with the grid assembly of the case loader.

Still with reference to FIG. 9, and the geometry of the finger socket, the end portion 22a of the finger 22 includes an upwardly facing pressure point 22c which is spaced inwardly of and disposed above the concave annular rib engaging portion 22b in order that this pressure point 22c on finger 22 can engage the annular flange 26c of the fastener and achieve the above mentioned motion of the finger 22 biased in the direction indicated previously by the spring 30. The retaining member 32 is tapered in the axial direction so as to have a smaller diameter at its lower end in order to provide clearance for the above mentioned movement of the finger 22 from the position shown in solid lines in FIG. 9 to the position indicated in phantom lines, and beyond said intermediate phantom line position.

Means is provided for locating the finger 22 circumaxially, that is such that each of the fingers 22, 22 are located as shown in FIG. 1 when they are biased toward their normal position as shown in that view. More particularly, and as suggested in FIG. 10, the finger 22 is adapted to be moved from the above mentioned normal position, perpendicularly with respect to the plane of pendulous movement of the finger 22, as for example when the finger 22 is engaged by a carton case or partition cell C. This lateral motion only occurs in the event that the finger is urged out of its normal position (shown in solid lines in FIG. 9) and in the event that the finger is engaged by the partition wall of the case C as suggested in FIG. 10. In this event, the finger 22 is adapted to rock on the annular rib 32a such that the biasing force of spring 30 will be overcome by this rocking motion of the finger 22 with the result that the finger will move laterally as shown in the lower portion of FIG. 10. As so constructed the finger mounting means can accommodate interference between a particular finger and the associated partition cell of the case. This rocking motion of the finger 22 is only possible after the finger has been moved away from its normal position referred to above, and it is a feature of the present invention that the finger is biased outwardly toward the center of its associated pocket and away from the fastener 26 with the result that the finger is normally seated in a centered position as suggested in FIG. 1 and does not move laterally when so located.

Turning next to a detailed description of the means for so locating the finger or fingers in the cluster as shown in FIG. 1, when these fingers are in their normal positions. The finger holder 16 will so locate the fingers by reason of the unique geometry provided in the depending skirt portion 16b best shown in FIG. 5 of the holder cavity or finger socket. This portion 16b is so constructed and arranged as to accommodate the finger 22 in only one particular position (that of the solid lines in FIG. 10). More particularly, the inwardly facing surface of the finger holder cavity 16a is provided with four symmetrically arranged convex surfaces 16b which mate with the concave upper end portions of the fingers 22d (best shown in FIG. 6) when the fingers are located in their normal positions (FIG. 1).

Each finger holder 16 is independently supported on an associated rail 14, and may be selectively positioned along the rail and secured in position by the screws 18 and 20. If desired, each rail may instead by provided with a longitudinal series of V-shaped notches such as shown in my prior co-pending application Ser. No. 963,361, filed Nov. 24, 1978, now U.S. Pat. No. 4,207,722 with a cone point set screw in the upper end of the holder to facilitate securing the holder to such a rail.

When it becomes necessary to repair or replace one or more of the fingers 22 which comprise the assembly, the clamping screw 26, which is accessible from below, is unthreaded from engagement with the nut 24. The retaining member 32, the clamping screw 26, and the fingers 22, 22 comprise a substantially unitary subassembly which may be removed from the cavity 16a as a unit. After removal, any broken or damaged finger 22 which requires repair or replacement may itself be readily removed from the retaining member. If necessary this removal may be facilitated by loosening the nut 28 so as to increase the clearance between annular member 32 and the flange or collar 26c of the fastener. More particularly the finger can be tilted in a sidewise direction so as to compress the spring 30 and increase the space between the retainer 32 and the flange 26c. Holding these parts in separated relationship in this manner permits one to remove one or more of the fingers. The lower end 26b of the fastener 26 permits the ready removal for replacement or repair of the cluster of corner fingers with a minimum of effort.

DETAILED DESCRIPTION OF FIGS. 11–22

Figure 11:
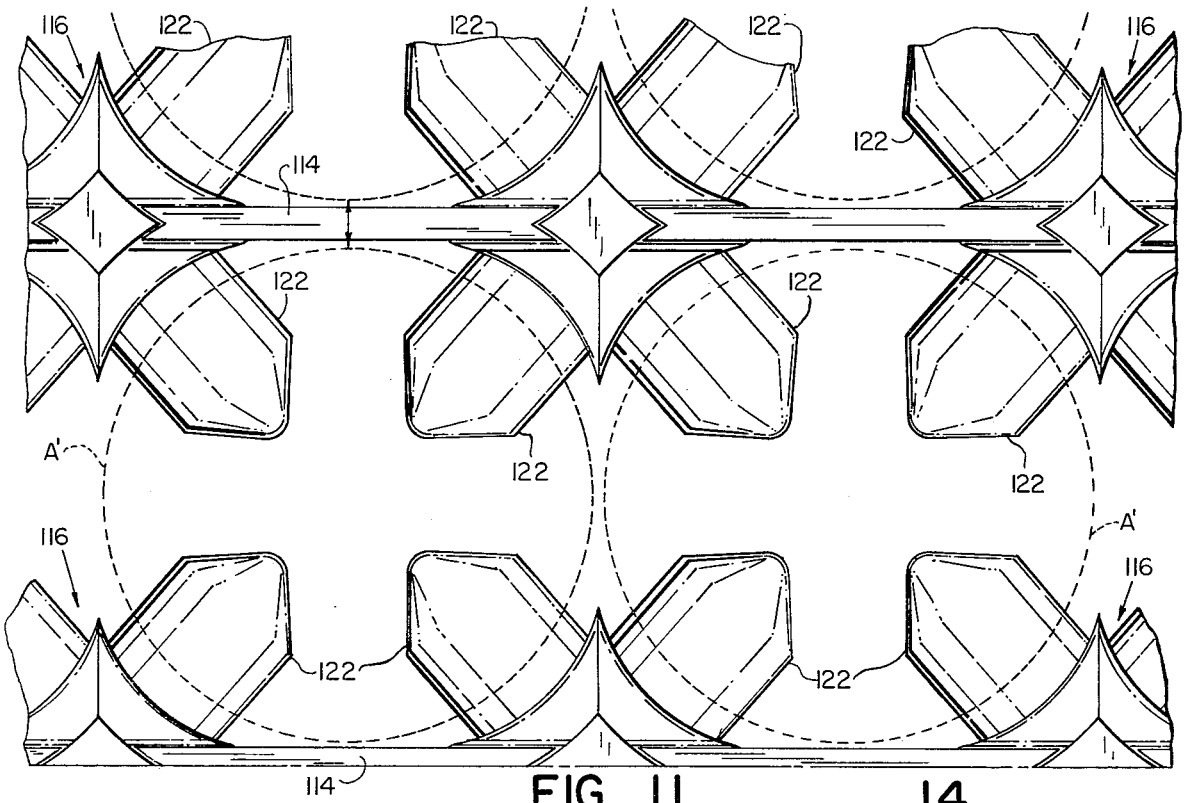
FIG. 11 is a fragmentary plan view of a portion of a case loader having finger assemblies of different configuration than those shown in FIGS. 1–10, but embodying some of the same features as embodied in those views.

Turning next to FIGS. 11–22 of the drawings an alternative embodiment of the invention is shown in FIG. 11 as including a plurality of finger assemblies 116, 116 secured to parallel rails 114, 114 to define a plurality of pockets for receiving articles to be loaded by gravity into a packing case. Two articles A′, A′ are illustrated in broken lines with reference to the two full or complete pockets shown in FIG. 11.

Figure 12:
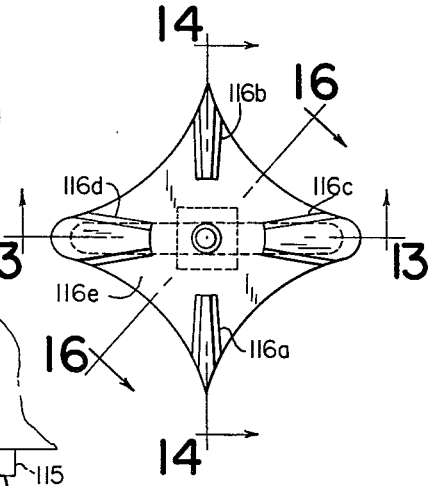
FIG. 12 is a bottom view of one of the holders depicted in FIG. 11, but with the fingers and retaining member omitted.
Figure 14:
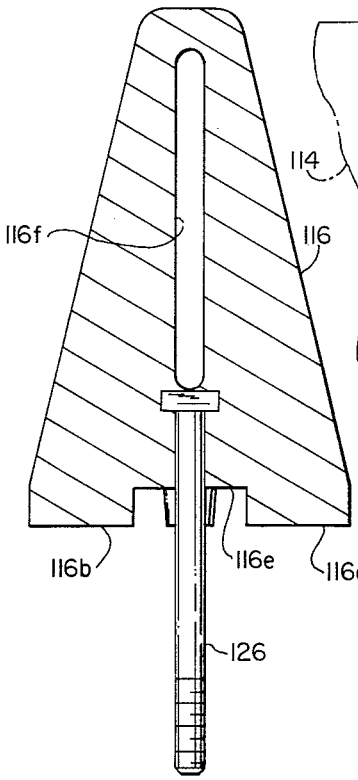
FIG. 14 is a vertical sectional view taken generally on the line 14—14 of FIG. 13.
Figure 13:
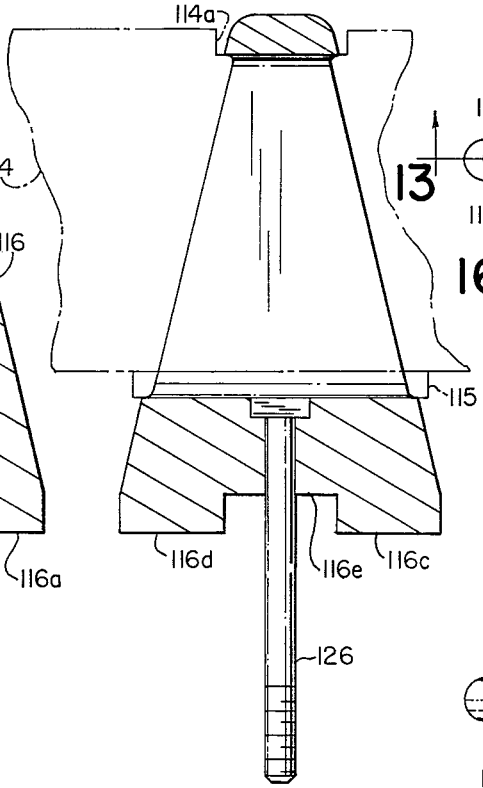
FIG. 13 is a vertical sectional view taken generally on the line 13—13 of FIG. 12 and with a cross rail of the case loader of FIG. 11 shown in part.
Figure 15:
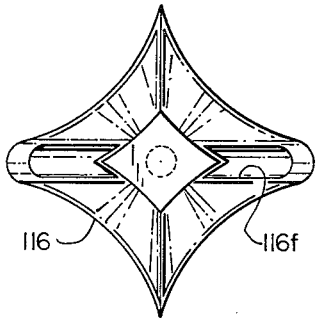
FIG. 15 is a plan view of the holder depicted in FIG. 12.
Figure 22:
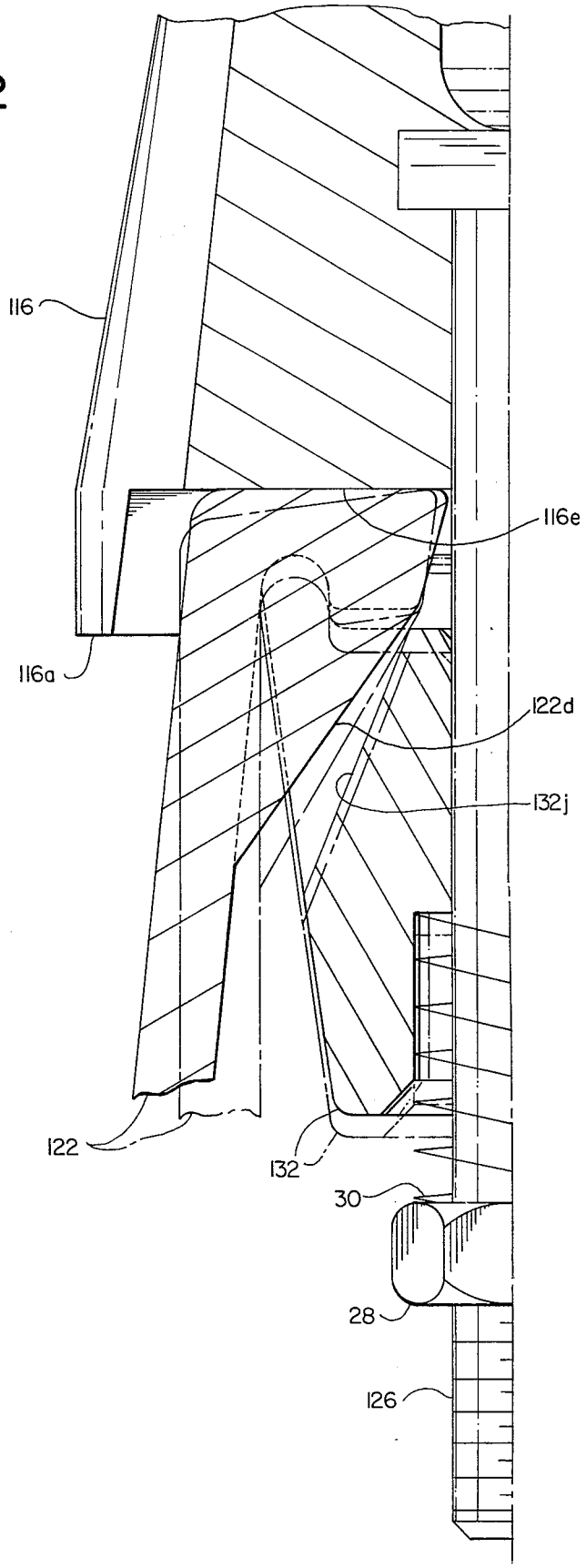
FIG. 22 is an enlarged view of the alternative embodiment of FIG. 16 with the finger in two alternative positions, the solid line position being its normal position and the phantom line position representing a position such that a downwardly moving article has pivoted the finger as the article passes downwardly through the pocket with which the finger is associated.

FIG. 14 shows a finger holder 116 mounted to the rail 114, and FIG. 13 shows the same holder 116 from a mutually perpendicular direction. Depending dividers 116*a*, 116*b*, 116*c*, 116*d* cooperate with the surface 116*e* to define individual cavities for the upper ends of the fingers 122, 122. Four such cavities are so defined in the lower end of each holder 116 as best shown in FIG. 12, and each such cavity has a flat horizontally extending surface portion of the flat area 116*e* referred to above. Each finger 122 has a generally triangular planform (best shown in FIG. 21) and the inner apex of the triangle provides a movable pivot point for the movable finger, as best shown in FIG. 22, wherein the finger 122 is depicted in two positions, the solid line position corresponding to the FIG. 11 positions and the phantom line position to an intermediate position.

The holder 116 is generally similar to the holder 16 described previously, but the fastener 126 is not removable from the holder 116 as is true of the fastener 26. Nevertheless, fastener 126 does yieldably support a retainer 132 by means of spring 30 and nut 28 as in the previous embodiment.

The retainer 132 is not annular in configuration, but is nearly square (actually of rhombus) shape to provide a more positive pivotal connection for the four fingers supported at the four sides of the retainer on upstanding individual ribs 132*a*, 132*b*, 132*c* and 132*d* (See FIG. 17). Each of these ribs supports a finger as shown in FIG. 16, and each finger 122 has a reinforcing web 122*d* for strengthening its hooked, or inturned upper end 122*a*. The top of each finger, 122*c*, is flat for the same reason as the top 22*c* of finger 22 is flat, that is to define the normal position for the finger as shown in FIG. 9 for the finger 22 and in FIG. 22 for finger 122.

These straight ribs of retainer 132 also dictate that the inturned upper ends of the fingers 122 have straight, rather than arcuate concave portions 22*b* (best shown in FIG. 21). However, these fingers 122, 122 function in the same way as the fingers 22, 22 in that each finger 122 is located (as it returns to the normal position shown in FIG. 16) by the rib 132*a*. These linear ribs obviate the need for the depending skirt 16*b* of holder 16, and the depending flange 116*a* prevents lateral motion of the finger in its socket (except for the slight lateral pivotal motion still possible for finger 122 as suggested by FIG. 10, that is by downward movement of the retainer as a result of interference between a case and that finger).

The retainer 132 is itself restricted from moving circumaxially around the fastener 126 by the depending flanges 116*a*, 116*b*, 116*c*, and 116*d*. Slots 132*e*, 132*f*, 132*g* and 132*h* receive said flanges for this purpose.

A detailed discussion of the finger assembly of FIGS. 11–22 is deemed to be unnecessary in view of the above description of the FIGS. 1–10 assembly. However, a few remarks about the advantages of the FIGS. 11–22 assembly over that of FIGS. 1–10 might be appropriate. This geometry not only allows the skirt of holder 16 to be eliminated, and provides a more positive pivot for the finger 122 (toward and away from the center of the pocket), but the off-square retainer 132 provides a slightly asymmetric pocket pattern (See FIG. 11) wherein the articles being handled A′, A′ are spaced more closely in one direction (perpendicular to the rails 114, 114) than the other (parallel these rails). The difference between these relative spacings permits a tighter pack of product as the articles are dropped into the waiting case, an advantage made possible by the unique retainer geometry and the fact that the rails run in only one direction.

Still with reference to the retainer 132, FIG. 17 show clearance slots 132*j* for loosely receiving the reinforcing ribs 122*d* of the four fingers 122 mounted in each finger assembly or holder 116. As best shown in FIG. 22, the finger 122 is free to move from its normal position to a deflected position, with corresponding positions for retainer 132, all without the rib 122*d* interfering with the slot 132*j*. This slot 132*j* is also wide enough to allow some movement of the fingers in the direction suggested by FIG. 10 with reference to the first embodiment.

FIG. 13 shows the rail 114 with an upwardly relieved portion 114*a* to locate the holder 116 longitudinally. A shim 15 may be provided at the lower edge of the holder opening 116*f* to lock the assembly in place on rail 114. Other constructions may also be used to assemble the holders as suggested in connection with the previous embodiment (FIG. 4).

DETAILED DESCRIPTION OF FIGS. 23–29

Figure 23:
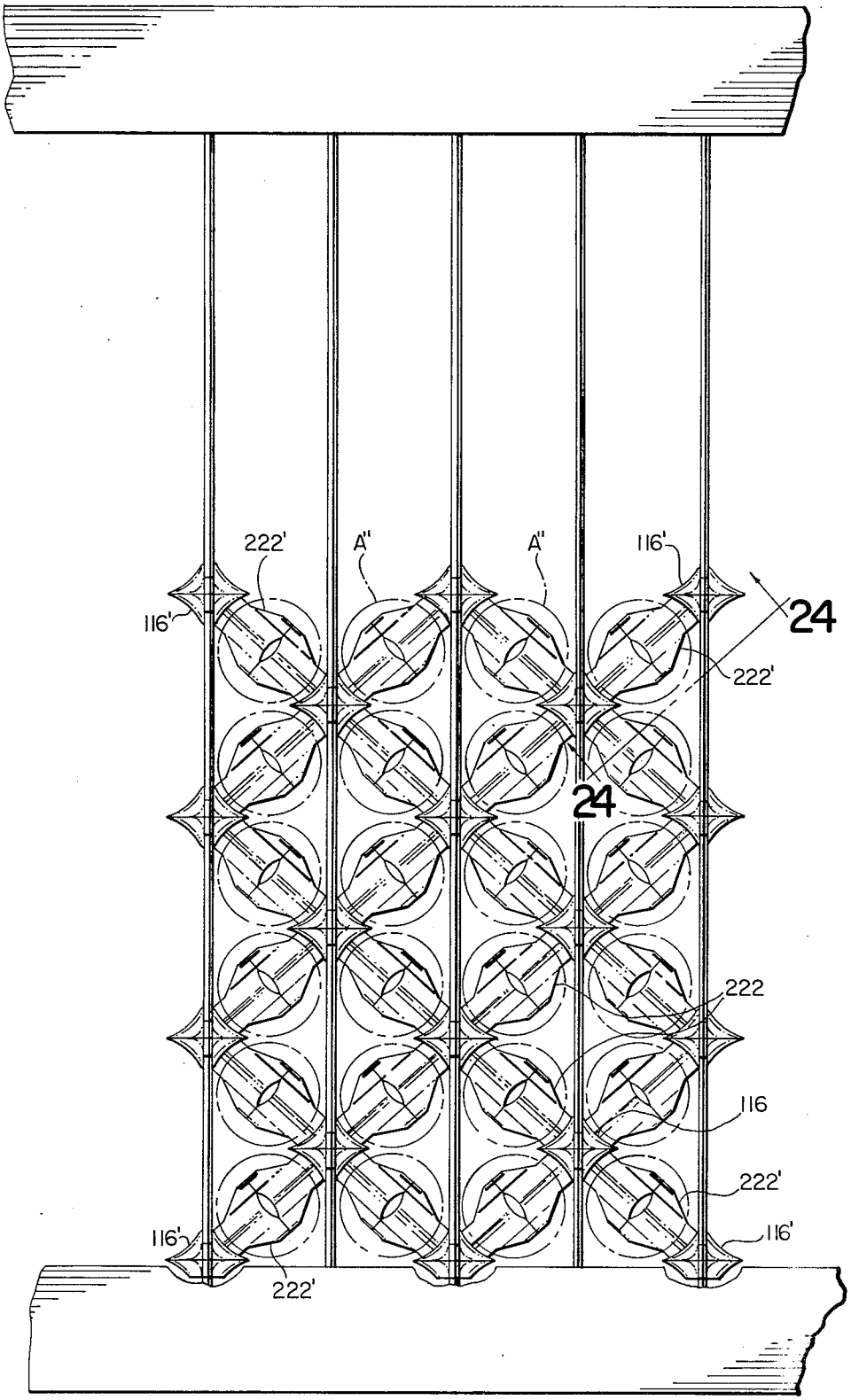
FIG. 23 is a fragmentary plan view of a portion of a case loader having finger assemblies similar to those depicted in FIGS. 11–22 but with fewer fingers and correspondingly fewer assemblies.
Figure 24:
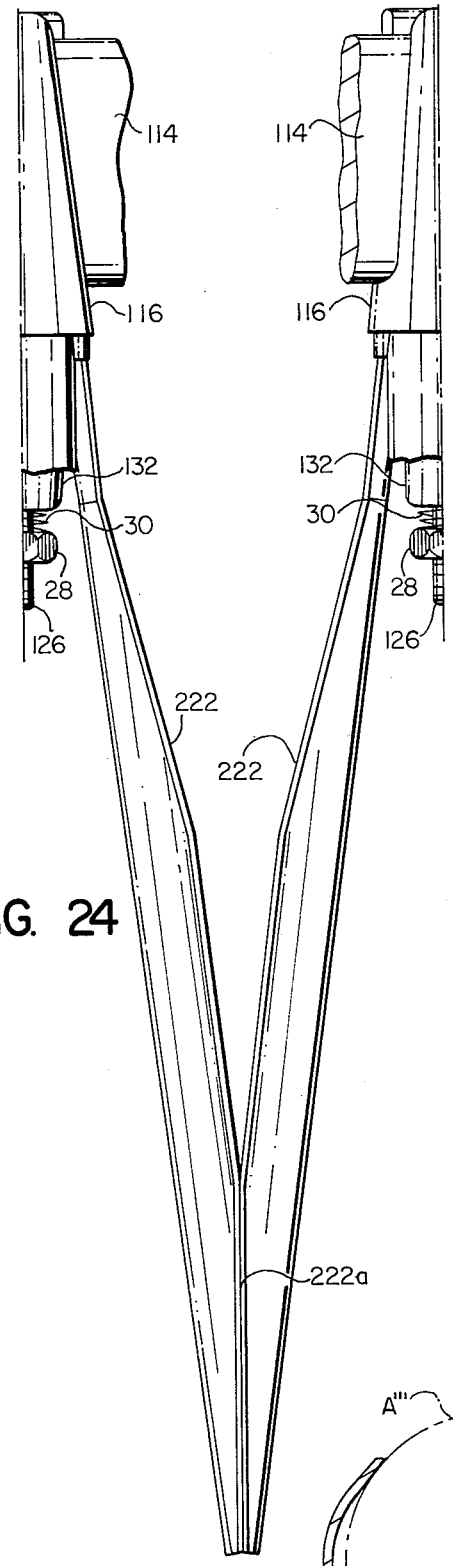
FIG. 24 is a vertical sectional view taken on the line 24—24 of FIG. 23 showing one individual pocket with only two fingers, the fingers having a unique shape such that their lower ends mate with another rather than being spaced apart as in the prior embodiments with four fingers per pocket.

Considering next the two finger per pocket embodiment illustrated in FIGS. 23–29, it will be apparent that the holder 116 and retainer 132 of the previous embodiment (FIGS. 11–22) can be fitted with only two (rather than four) fingers per article passageway or pocket and that this permits a corresponding reduction in the number of holders and retainers as suggested in FIG. 23. The fingers 222, 222 are considerably wider, and somewhat longer than those described above with reference to FIGS. 19 and 20 as suggested by a comparison of FIGS. 11 and 23. The lower ends of the fingers 222 actually abut one another (as best shown in FIG. 24) whereas the fingers 122 of FIG. 11 do not (as best shown in FIG. 11).

Still with reference to FIG. 23, it has been found advantageous, in this two finger per pocket grid, to provide a holder 116′ at each corner of the array or slug of articles to be dropped so that the corner most finger 222′ in the grid will enter the corner of the case to be loaded. This consideration is automatically provided for in the four finger per pocket grides described previously, but must be consciously provided for in the arrangement of FIG. 23.

As mentioned previously, the fingers 222, 222 are considerably wider and somewhat longer than those described above with reference to FIGS. 19 and 20. Nevertheless, the upper ends of these fingers 222 are identical to the upper ends as described with reference to FIG. 16 and finger 122. Furthermore, the upper ends of the fingers 222, 222 are held between a holder 116 and a retainer 132 by a single fastener and spring 30 just as described for finger 116 in FIG. 16.

Figure 25:
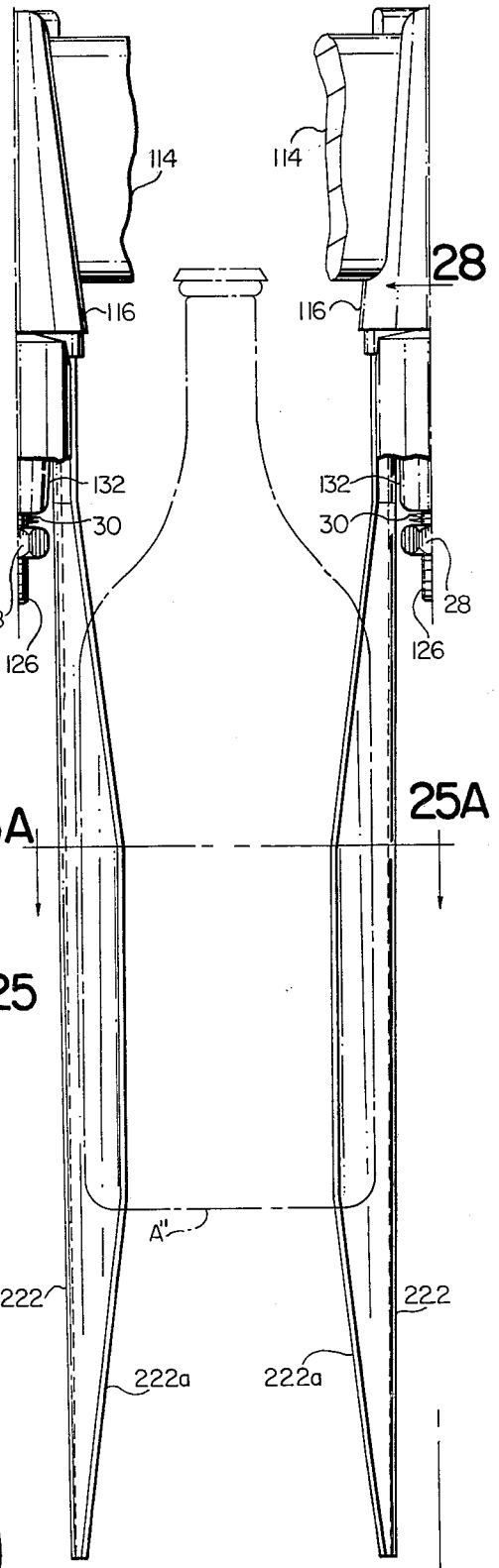
FIG. 25 is a view similar to FIG. 24 by illustrating the two fingers spread apart by a descending article being loaded.

As best shown in FIGS. 24 and 25 the two fingers 222, 222 will normally assume a position such that their tapered lower end portions touch one another, and the force which urges these fingers into contact with one another comes from the holder springs 30, 30 associated with each finger assembly.

Figure 25A:
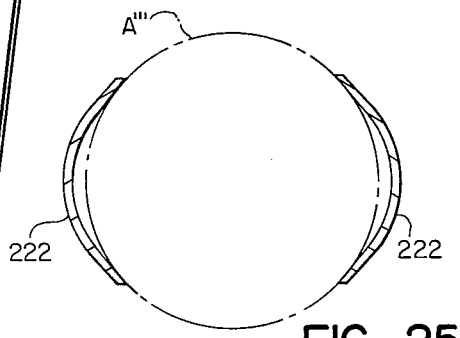
FIG. 25A is a horizontal sectional view on the line 25*a*—25*a* of FIG. 25.
Figure 26:
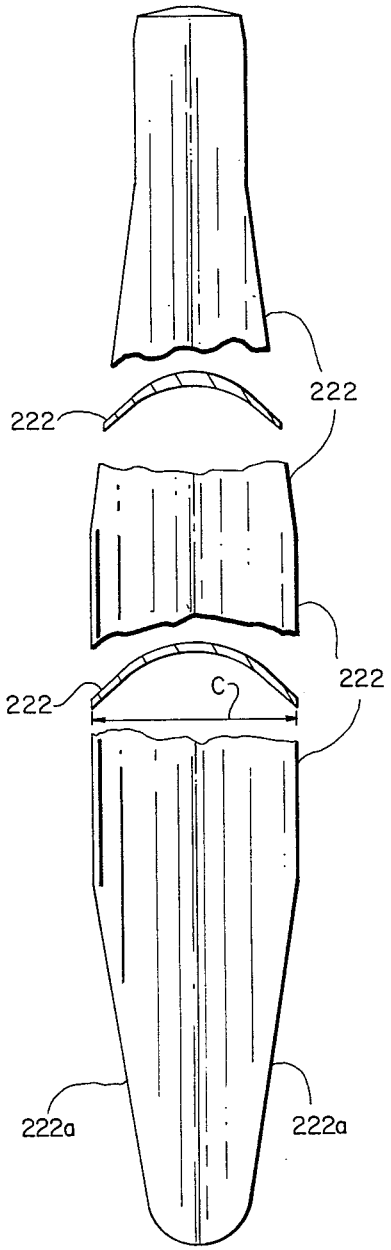
FIG. 26 is a front elevational view of one of the two identical fingers shown in FIG. 25, with cross sectional shapes of the finger also provided.
Figure 27:
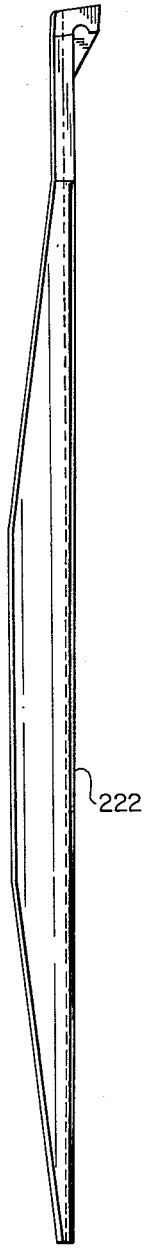
FIG. 27 is a side elevational view of the FIG. 26 finger.
Figure 28:
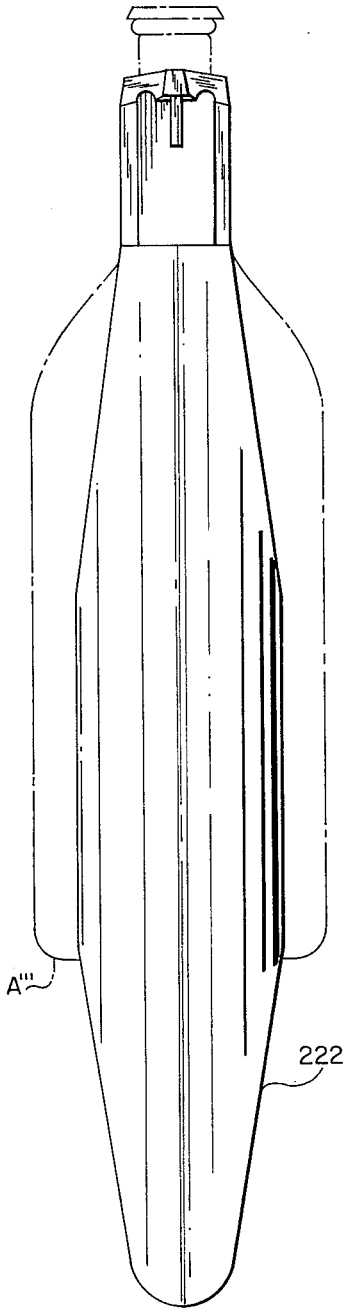
FIG. 28 is a rear elevational view of the finger illustrated in FIGS. 26 and 27 and with an article of representative size as it would appear in relation to the finger during descent (see line 28—28 in FIG. 25 for the direction of this view).

As shown in FIG. 23, these fingers are designed to receive the descending articles A", A" and to have a cross sectional shape (See FIG. 26) such that a substantial portion of the circumferential lateral surface area of the article is encompassed by the arcuately shaped finger to guide it during descent. For example, in handling articles of approximately 8–8½ inches in circumference (a typical beverage bottle or can of 12 fluid ounces) the fingers 222 preferably have a chord C at the point of maximum width of approximately 2 inches. With two fingers diametrically opposite one another in each pocket (as shown in FIG. 23) and with this geometrical relationship between the article diameter and finger chord (FIG. 28) the cylindrical body portion of the article A''' is encircled by the arcuate fingers to approximately at least, encompass one half the article circumference (See FIG. 25*a*).

As so constructed and arranged the articles A''', A''' to be loaded into the upwardly open packing case can be accurately guided during descent with only two fingers rather than the usual four fingers associated with each pocket or article passageway in a typical grid.

Referring more specifically to the drawings of finger 222, the upper portion has the same configuration as finger 122 described previously with reference to the four finger per pocket version of FIGS. 11–22. The lower portion of finger 222 is preferably tapered so that the edges 222*a* can come together in their normal or neutral positions, as suggested in FIG. 24 (and unlike the neutral positions of the fingers 22 in FIG. 1 and 122 in FIG. 11).

As suggested in FIG. 29 the two fingers 222, 222 not only guide the article "A" during its downward movement toward the case C, but where that case C has individual cells defined by partitions or dividers C' and C" these fingers also serve to penetrate the case cells to guide the article into an associated cell. With prior art corner fingers one disadvantage that has been encountered can be attributed to the fact that paper labels applied to the article "A" sometimes become scuffed as a result of engagement between the article's periphery and the partitions in the areas designated by reference numeral 250. Such a disadvantage is avoided in the two finger configuration shown in FIGS. 23–29 by reason of the relative dimensions referred to previously.

DETAILED DESCRIPTION OF FIGS. 30 AND 31

Where one does not want to utilize two plastic fingers as described above, as for example where the article being handled is of such a size and shape relative to its weight as to dictate that four corner fingers per pocket be provided as described above with reference to FIGS. 1–22, and yet the disadvantage of the label scuffing must be avoided as well, the geometry of the plastic fingers themselves can be varied as suggested in FIGS. 30 and 31.

The finger 322 of FIGS. 30 and 31 has an upper portion 322*e* identical to that of the fingers 122 and 222 described previously, that is, said fingers are adapted to be mounted in clustered relationship at each corner of the pockets defined by the grid structures as discussed previously.

The lower portion of each finger 322 is tapered to facilitate entry of the finger into a partitioned case as described above with reference to FIG. 8. Furthermore, the fingers 322 are provided with marginal side ribs 322*a*, 322*a* so that these relatively narrow fingers will nevertheless prevent contact between the article A''' and the carton partitions C' and C". It will be apparent from FIG. 31 that undesirable scuffing of the paper label on the article A''' is avoided by reason of the presence of these ribs 322*a*, 322*a*. The tapered lower portion of the finger 322 has tapered rib portions 322*b*, 322*b* such that the lowermost portion 322*c* of the finger has no marginal ribs and is of minimum cross-sectional size (as suggested in FIG. 20 for finger 122 for example).

Finally, and still with reference to the plastic finger 322 of FIGS. 30 and 31, a central rib 322*d* extends the entire length of the finger and serves to stiffen the flexible plastic finger particularly in the area of the lowermost portion 322*c*. While it is desirable to have the plastic finger exhibit a degree of flexibility and resiliency, it is also advantageous to provide for the tip portion 322*c* to be stiffened slightly as a result of the medial rib 322*d*, and for the marginal ribs 322*b*, 322*b* and this medial rib 322*d* to have upper ends terminating well below the upper end portion 322*e* as shown in FIG. 30.

I claim:

1. A finger assembly for a case loader comprising a finger holder mounted to the loader, a finger retaining member cooperating with said holder to define a plurality of finger sockets therebetween, an axially elongated fastener extending in a generally vertical direction centrally through an opening in said retaining member and secured to said holder, a plurality of fingers having upper ends inturned toward the axis of said fastener for pendulously supporting said fingers in said sockets for movement inwardly toward and outwardly away from the axis of said fastener, each finger having a portion of said inturned end with a downwardly facing concave contour slidably engaging a convex rib portion of said retaining member to pendulously support each finger for movement inwardly toward and outwardly away from said central fastener, and biasing means comprising a spring member acting between said retaining member and said holder to resiliently biase said upper ends of said fingers into said sockets to thereby urge said fingers outwardly relative to said axis of said fastener to cooperate with the fingers of other such finger assemblies to form pockets through which articles drop to load a case.

2. The finger assembly of claim 1 wherein said convex rib portion of said retaining member for so engaging said concave portion of said finger comprises a raised rib on said retaining member extending peripherally around said retaining member to so support up to four such fingers.

3. The finger assembly of claim 2 wherein said retaining member has at least four angularly related sides, each such side defining a raised linear rib, and each finger having a downwardly facing concave contour for slidably engaging one of said ribs to so support each finger pendulously.

4. The finger assembly of claim 1 further characterized by an upwardly facing surface of said inturned upper end of said finger which is so shaped as to inhibit finger movement out of a vertical plane wherein said finger surface engages a complementary flat face defined by said holder, whereby each finger tends to return to said vertical plane position but is capable of limited side-to-side movement against the bias of said coiled spring.

5. The finger assembly of claim 1 further characterized by said fastener threadably received in said holder and having a shoulder cooperating with the holder to define an upper boundary of said finger socket such that said fingers and retaining member and said fastener comprise a subassembly readily removable from said holder.

6. The finger assembly of claim 1 wherein said biasing means comprises a coiled compression spring surrounding a lower end of said fastener and having one end engaging said retaining member and the other end engaging said fastener.

7. The finger assembly of claim 6 further characterized by a nut threadably received on said fastener to engage said spring, said nut being rotatable to vary the biasing force exerted through said retaining member to bias said fingers outwardly.

8. The finger assembly of claim 7 further characterized by an upwardly facing surface of said inturned upper end of said finger which is so shaped as to inhibit finger movement out of a vertical plane wherein said finger surface engages a complementary flat face defined by said holder, whereby each finger tends to return to said vertical plane position but is capable of limited side-to-side movement against the bias of said coiled spring.

9. The finger assembly of claim 7 wherein said convex rib portion of said retaining member for so engaging said concave portion of said finger comprises a raised rib on said retaining member extending peripherally around said retaining member to so support up to four such fingers.

10. The finger assembly of claim 9 further characterized by an upwardly facing surface of said inturned upper end of said finger which is so shaped as to inhibit finger movement out of a vertical plane wherein said finger surface engages a complementary flat face defined by said holder, whereby each finger tends to return to said vertical plane position but is capable of limited side-to-side movement against the bias of said coiled spring.

11. The finger assembly of claim 9 wherein said fingers are formed from an injection molded plastic and each finger has an intermediate portion of arcuate cross sectional shape and a lower portion of tapered width to facilitate entry of the finger into a case.

12. The finger assembly of claim 11 wherein said plastic material is resilient and flexible, said arcuate cross sectional shape being more particularly crescent shaped to permit the fingers to flex and bend.

13. The finger assembly of claim 1 further characterized by said convex portions of said retaining member being four in number and said retaining member having four sides to provide a rhombus shape with four corner vertices of the rhombus, said holder having depending flanges for receiving at least two vertices of said retaining member to orient said retaining member relative to said holder and to pendulously support up to four fingers in each such assembly.

14. The finger assembly of claim 1 further characterized by said inturned upper ends of each said fingers defining an upwardly facing pressure point spaced vertically above said downwardly facing concave contour thereof to facilitate their pendulous movement.

15. The finger assembly of claim 14 wherein said inturned upper ends of each of said fingers defines an upwardly facing surface which is so shaped so to inhibit finger movement out of a vertical plane wherein said finger moves pendulously as aforesaid, each finger tending to be returned to said vertical plane at least when said finger has moved outwardly to a limit position, said holder and said finger's upwardly facing surface providing limited side-by-side movement at least when said finger is not in said limited position.

* * * * *